US005449102A

United States Patent [19]

Sason

[11] Patent Number: 5,449,102

[45] **Date of Patent: * Sep. 12, 1995**

[54] BACKPACK

[75] Inventor: Dan Sason, Kochav Yair, Israel

[73] Assignee: Modan Industries(1983) Ltd., Tel Aviv, Israel

[ * ] Notice: The portion of the term of this patent subsequent to Feb. 8, 2011 has been disclaimed.

[21] Appl. No.: 175,153

[22] Filed: Dec. 29, 1993

[30] Foreign Application Priority Data

Jun. 10, 1993 [IL] Israel ..... 105983

[51] Int. Cl.[6] ..... A45F 3/08

[52] U.S. Cl. ..... 224/211; 224/215; 224/209

[58] Field of Search ..... 224/209, 210, 211, 213, 224/214, 215, 216, 259, 260, 261, 262, 263, 202, 205, 208

[56] References Cited

U.S. PATENT DOCUMENTS

| | | | |
|---|---|---|---|
| 3,347,429 | 10/1967 | Ruth, Jr. | 224/211 |
| 3,355,075 | 11/1967 | Dean | 224/24 |
| 4,013,201 | 3/1977 | Potter | 224/211 |
| 4,179,826 | 12/1979 | Davidson . | |
| 4,369,903 | 1/1983 | Wilkes | 224/212 |
| 4,420,103 | 12/1983 | Douglass . | |
| 4,504,002 | 3/1985 | Hall | 224/211 |
| 4,676,418 | 6/1987 | Lowe | 224/215 |
| 4,739,913 | 4/1988 | Moore . | |
| 4,744,601 | 5/1988 | Nakanishi . | |
| 4,750,654 | 6/1988 | Menetrier . | |
| 4,815,361 | 3/1989 | Chiarella . | |
| 4,860,936 | 8/1989 | Lowe | 224/210 |
| 4,884,731 | 12/1989 | Sibley . | |
| 4,986,458 | 1/1991 | Linday | 224/216 |
| 5,004,135 | 4/1991 | Dufournet et al. | 224/210 |
| 5,184,763 | 2/1993 | Blaisdell et al. | 224/211 |
| 5,184,764 | 2/1993 | Orovan et al. | 224/211 |
| 5,191,752 | 3/1993 | Murphy . | |
| 5,284,279 | 2/1994 | Sason et al. | 224/209 |
| 5,361,955 | 11/1994 | Gregory | 224/211 |

FOREIGN PATENT DOCUMENTS

| | | | |
|---|---|---|---|
| 351333 | 1/1990 | European Pat. Off. . | |
| 551733 | 7/1993 | European Pat. Off. | 224/211 |
| 567173 | 10/1993 | European Pat. Off. | 224/211 |
| 2313886 | 6/1975 | France . | |
| 2406402 | 10/1977 | France . | |
| 2670096 | 6/1992 | France . | |
| 3605532 | 8/1987 | Germany . | |
| 8816653 | 3/1990 | Netherlands . | |
| 667195 | 9/1985 | Switzerland . | |
| 678796 | 11/1991 | Switzerland . | |
| 9105494 | 5/1991 | WIPO . | |

OTHER PUBLICATIONS

Patent Abstracts of Japan publication No. JP2099054.

*Primary Examiner*—Henry J. Recla
*Assistant Examiner*—Gregory M. Vidovich
*Attorney, Agent, or Firm*—Ladas & Parry

[57] ABSTRACT

A backpack having an article carrier; a waist belt attached to the article carrier and arranged for fastening the article carrying apparatus about the waist of a user; shoulder supports arranged for fastening the article carrier about an upper body portion of the user; and apparatus for attaching the shoulder supports to the article carrier and including apparatus for adjusting the position of attachment of the shoulder supports to the article carrier so as to selectably increase and decrease the distance between a position of attachment of the shoulder supports to the article carrier relative to the position of attachment of the waist belt to the article carrier while the backpack is being worn by the user.

6 Claims, 15 Drawing Sheets

BACKPACK

FIELD OF THE INVENTION

The present invention relates to backpacks generally.

BACKGROUND OF THE INVENTION

Backpacks have been known for many years as a convenient means of carrying loads on the back of a person while leaving his hands free. Backpacks are most typically used by military personnel in the field and by mountaineers and hikers.

A modern backpack is typically equipped with adjustable shoulder supports and a waist belt, both attached to the main pouch, or to a frame associated therewith, so as to most efficiently and comfortably locate the backpack on the back of a user. It has been recognized, however, as being desirable to enable adjustment of the position of the shoulder supports relative to the waist belt so as to fit the backpack with maximum comfort onto the back of a person.

One type of backpack on the market employs adjustable length straps for attaching the shoulder supports to the main pouch frame. A further type of backpack on the market employs a generally vertical track to which the shoulder supports are attached, the position of the shoulder supports being determined by tightening of a screw so as to fix them in a selected position. A disadvantage of the systems employed by these two backpacks is that the distance between the shoulder supports and the waist belt cannot be adjusted while the backpack is located on a person's back.

A further backpack on the market employs a shoulder support adjustment system wherein the shoulder supports are attached via adjustable straps to a track mounted on an adjacent portion of the pouch. While this system permits a reduction in the distance between the shoulder supports and the waist belt while the backpack is being worn, the back pack must be removed from the back of the wearer in order to increase the shoulder support-waist belt distance. A further disadvantage of this backpack is that it is properly supported on the back only when the weight of the load being carried in the backpack is predominantly exerted in the direction of the hips, or down the back. If the wearer of the backpack bends over forwards, however, the backpack tends to slip off the back.

SUMMARY OF THE INVENTION

The present invention seeks to provide a system for enabling adjustment of the distance between the shoulder supports and the waist belt of a backpack while the backpack is being worn, wherein the system also provides support to a load being carried in the backpack, regardless of the orientation thereof.

There is provided, therefore, in accordance with an embodiment of the invention, a backpack having an article carrier; a waist belt attached to the article carrier and arranged for fastening the article carrying apparatus about the waist of a user; shoulder supports arranged for fastening the article carrier about an upper body portion of the user; and apparatus for attaching the shoulder supports to the article carrier and including apparatus for adjusting the position of attachment of the shoulder supports to the article carrier so as to selectably increase and decrease the distance between a position of attachment of the shoulder supports to the article carrier relative to the position of attachment of the waist belt to the article carrier while the backpack is being worn by the user.

Additionally in accordance with an embodiment of the invention, the adjustment apparatus includes a track mounted onto the article carrier; a sliding buckle attached to the shoulder supports and configured for sliding along the track, and having a body portion and first and second buckle portions; a first elongate, flexible fastening element attached to the article carrier and extending through the buckle in association with the first buckle portion; and a second elongate, flexible fastening element attached to the article carrier and extending through the buckle in association with the second buckle portion, the body portion and the first and second buckle portions being configured to cooperate so as to selectably lock together the buckle and either of the first and second flexible fastening elements, thereby locking together the shoulder supports and the article carrier.

Further in accordance with an embodiment of the invention, the body portion is attached to the shoulder supports and defines first and second openings through which the first and second flexible fastening elements respectively extend. In addition, the first buckle portion is arranged in association with the first opening such that the first flexible fastening element extends through the first opening tangentially to the first buckle portion and thereabout so as to form a first loop between the first buckle portion and the body portion, and back out through the first opening; and the second buckle portion is arranged in association with the second opening such that the second flexible fastening element extends through the second opening tangentially to the second buckle portion and thereabout so as to form a second loop between the second buckle portion and the body portion, and back out through the second opening.

Additionally, in accordance with an embodiment of the invention, the backpack also includes apparatus enabling a predetermined displacement of the first buckle portion relative to the body portion in response to at least a predetermined force applied via the first flexible fastening element, the predetermined displacement causing entrapment of the first loop between the first buckle portion and the body portion, thereby locking the first flexible fastening element to the buckle, and thereby also locking together the shoulder supports and the article carrier.

Further in accordance with an embodiment of the invention, the apparatus enabling a predetermined displacement of the first buckle portion also includes apparatus enabling a predetermined displacement of the second buckle portion relative to the body portion in response to at least a predetermined force applied via the second flexible fastening element, the predetermined displacement causing entrapment of the second loop between the second buckle portion and the body portion, thereby locking the second flexible fastening element to the buckle, and thereby also locking together the shoulder supports and the article carrier.

Additionally in accordance with an embodiment of the invention, the adjustment apparatus also includes apparatus for slidably mounting the first and second buckle portions within the body portion of the buckle, which apparatus includes a resilient compression member for applying a predetermined locking force, via the first buckle portion, so as to lockably engage a portion of the first flexible fastening element between the first buckle portion and the body portion, thereby enabling the second flexible fastening element, in the absence of the predetermined force being applied therealong, to be pulled through the buckle by the user, thereby increasing the distance between the position of attachment of the shoulder supports to the article carrier relative to the position of attachment of the waist belt to the article carrier, application to the resilient member of a force greater than the predetermined locking force and in an opposite direction thereto causing the second flexible fastening element to be freed from locking engagement with the first buckle portion and the body portion, thereby enabling movement of the second elongate flexible element through the buckle so as to decrease decreasing the distance between the position of attachment of the shoulder supports to the article carrier relative to the position of attachment of the waist belt to the article carrier.

In accordance with a further embodiment of the invention, there is provided a backpack having article carrier; shoulder supports arranged for fastening the article carrier about an upper body portion of the user; and apparatus for attaching the shoulder supports to the article carrier and including apparatus for adjusting the position of attachment of the shoulder supports to the article carrier while the backpack is being worn by the user.

The adjustment apparatus includes a track mounted onto the article carrier; a sliding buckle attached to the shoulder supports and configured for sliding along the track, and having a body portion and first and second buckle portions; a first elongate, flexible fastening element attached to the article carrier and extending through the first buckle portion; and a second elongate, flexible fastening element attached to the article carrier and extending through the second buckle portion, wherein the body portion and the first and second buckle portions are configured to cooperate so as to selectably lock together the buckle and either of the first and second flexible fastening elements, thereby locking together the shoulder supports and the article carrier.

Additionally in accordance with a preferred embodiment of the present invention, there is provided a backpack comprising:

article carrying apparatus;

a waist belt attached to said article carrying apparatus and arranged for fastening said article carrying apparatus about the waist of a user;

shoulder support apparatus arranged for fastening said article carrying apparatus about an upper body portion of the user; and apparatus for attaching said shoulder support apparatus to said article carrying apparatus and including apparatus for adjusting the position of attachment of said shoulder support apparatus to said article carrying apparatus so as to selectably increase and decrease the distance between a position of attachment of said shoulder support apparatus to said article carrying apparatus relative to the position of attachment of said waist belt to said article carrying apparatus while said backpack is being worn by the user, and wherein said apparatus of adjusting comprise first and second manual engagement elements accessible to the user adjacent the waist belt, whereby pulling on said first manual engagement element raises the position of attachment of said shoulder support apparatus relative to the position of attachment of said waist belt and pulling on said second manual engagement element lowers the position of attachment of said shoulder support apparatus relative to the position of attachment of said waist belt.

Preferably the apparatus for adjusting comprises:

track apparatus mounted onto the article carrying apparatus;

sliding buckle apparatus attached to the shoulder support apparatus and configured for sliding along the track apparatus, and having a body portion and first and second buckle portions;

first elongate, flexible fastening apparatus attached to the article carrying apparatus and extending through the buckle apparatus in association with the first buckle portion; and second elongate, flexible fastening apparatus attached to the article carrying apparatus and extending through the buckle apparatus in association with the second buckle portion, and wherein the body portion and the first and second buckle portions are configured to cooperate so as to selectably lock together the buckle apparatus and at least one of the first and second flexible fastening apparatus, thereby locking together the shoulder support apparatus and the article carrying apparatus, and the first manual engagement element is connected to the first flexible fastening apparatus and the second manual engagement element being connected to the second flexible fastening apparatus.

Additionally in accordance with a preferred embodiment of the present invention there is provided a backpack comprising:

article carrying apparatus;

a waist belt attached to the article carrying apparatus and arranged for fastening the article carrying apparatus about the waist of a user;

shoulder support apparatus arranged for fastening the article carrying apparatus about an upper body portion of the user and including a pair of shoulder straps; and a connection strap assembly including a pair of track inclined track elements, a pair of track riding buckle members, which are slidably retained on the track elements and a pair of connection straps joined by the track riding buckle members between the track elements and the shoulder straps.

Preferably the connection strap assembly is configured such that notwithstanding variations in the height of the shoulder straps relative to the article carrying apparatus, an angle of between about 10–20 degrees is maintained between the connection straps 144 and the perpendicular to a back surface of the article carrying apparatus.

In accordance with a preferred embodiment of the present invention, the track riding buckle members are reversibly mountable onto the track elements thereby to adapt to different user body girths.

Preferably the track elements are inclined inwardly and downwardly.

Additionally in accordance with a preferred embodiment of the present invention there is provided a backpack comprising:

article carrying apparatus;

a waist belt attached to the article carrying apparatus and arranged for fastening the article carrying apparatus about the waist of a user;

shoulder support apparatus arranged for fastening the article carrying apparatus about an upper body portion of the user; and apparatus for attaching the waist belt to the article carrying apparatus and providing multiple degrees of freedom of motion between the waist belt and the article carrying apparatus.

Preferably the multiple degrees of motion include at least rotation in a plane of rotation and pivoting motion in at least one plane perpendicular to the plane of rotation.

BRIEF DESCRIPTION OF THE DRAWINGS

The present invention will be more fully understood and appreciated from the following detailed description, taken in conjunction with the drawings, in which.

DETAILED DESCRIPTION OF A PREFERRED EMBODIMENT

Figure 1B:
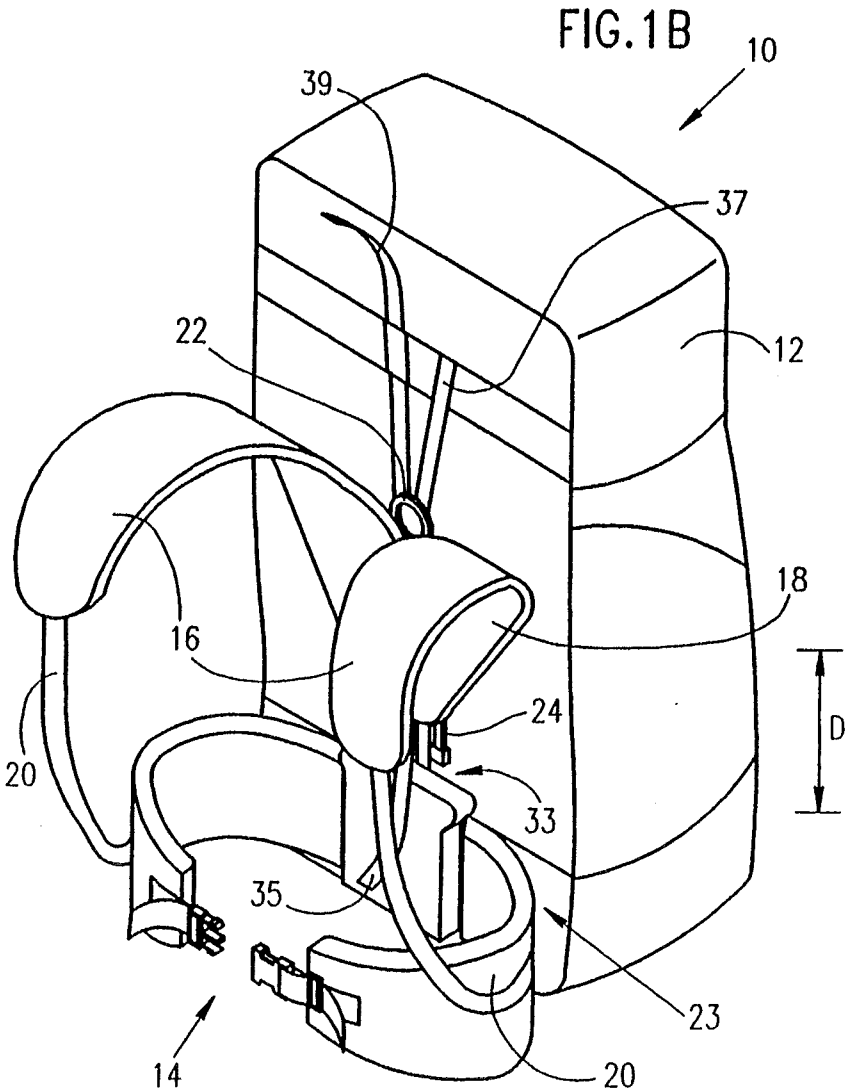
FIG. 1B is a general view of the backpack illustrated in FIG. 1A, wherein the shoulder support-waist belt distance has been adjusted to a minimum.
Figure 1A:
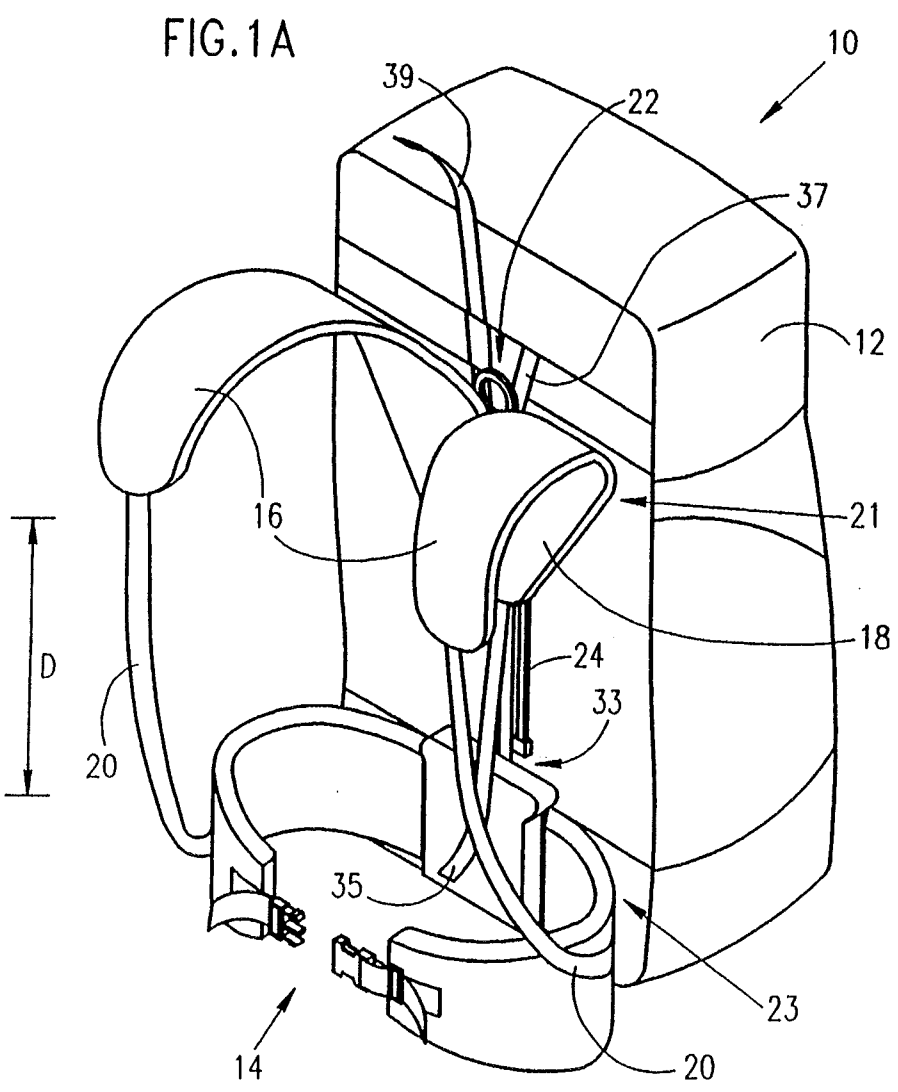
FIG. 1A is a general view of a backpack employing a system for adjusting the distance between shoulder supports and a waist belt of the backpack in accordance with the present invention, wherein the shoulder support-waist belt distance is illustrated at a maximum.
Figure 2C:
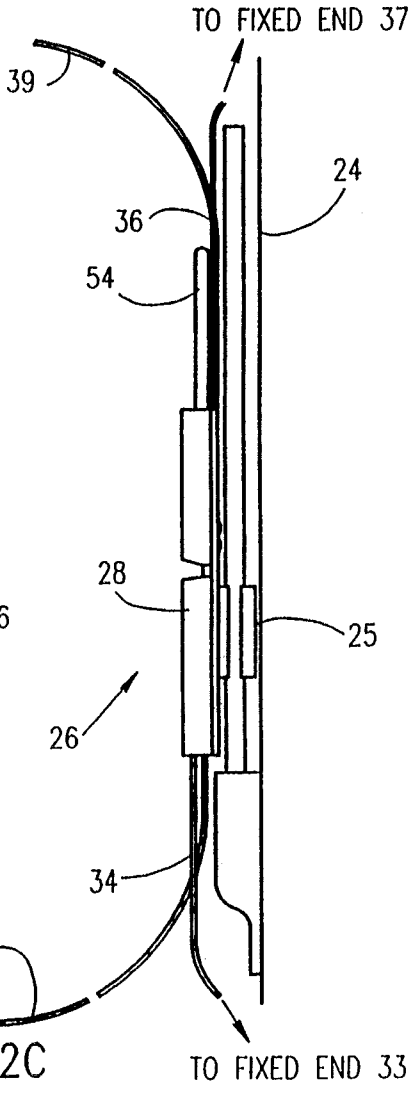
FIG. 2C is a side view of the track-mounted sliding strap buckle illustrated in FIG. 2B and taken in the direction of arrow 2C.
Figure 2B:
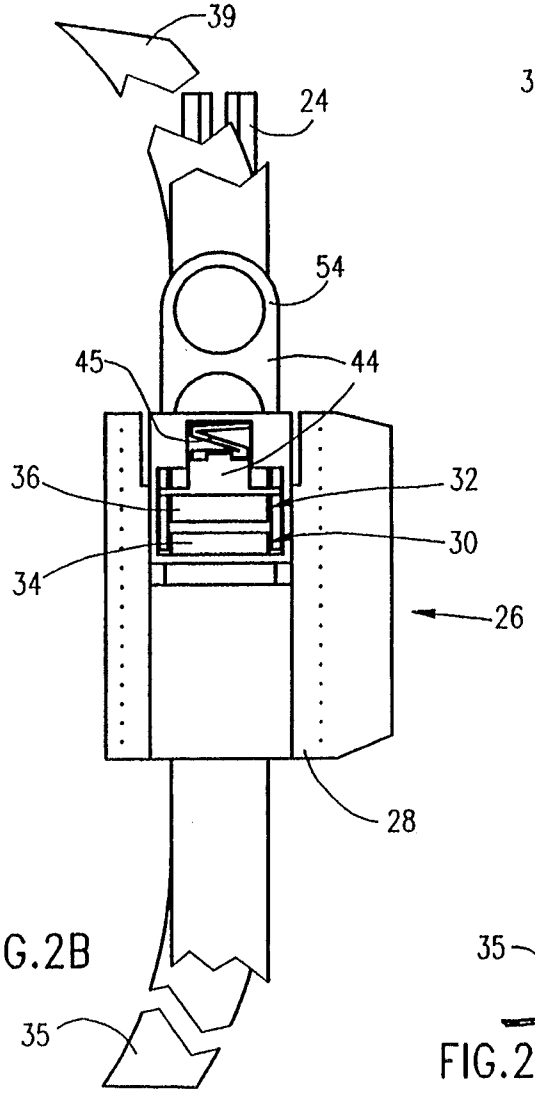
FIG. 2B is a front view of the track-mounted sliding strap buckle illustrated in FIG. 2A.
Figure 2A:
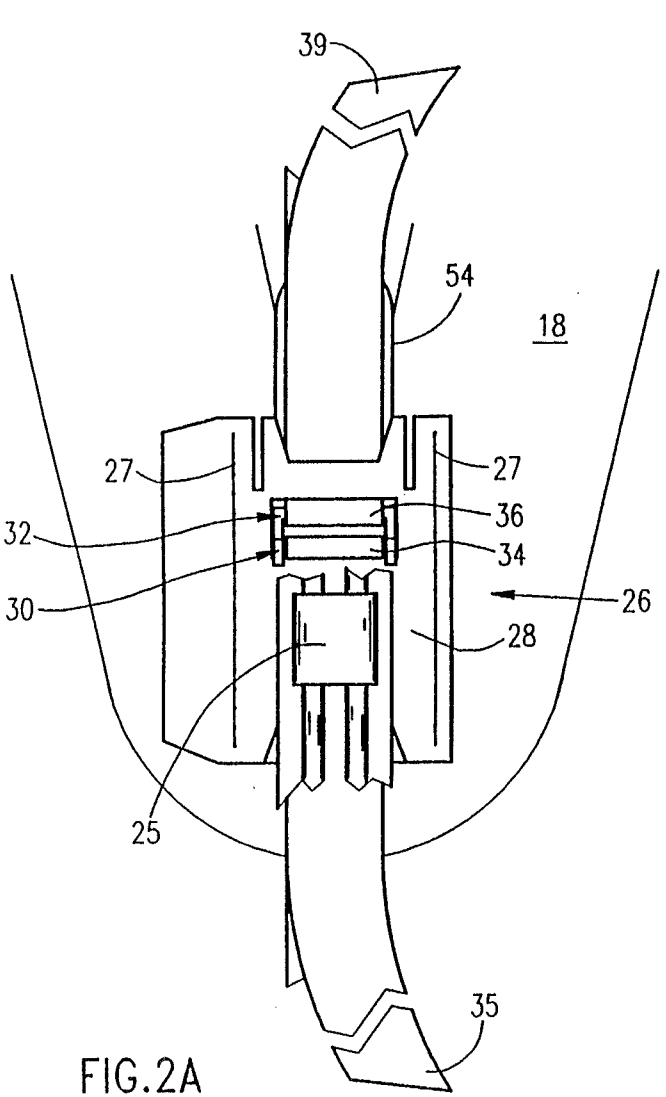
FIG. 2A is a rear view of a nape pad and track-mounted sliding strap buckle forming part of the shoulder support-waist belt distance adjustment system of the present invention.

Reference is now made to FIGS. 1A and 1B in which is illustrated a backpack 10 constructed in accordance with a preferred embodiment of the invention. The backpack 10 includes a generally pouch-shaped article carrying portion 12, a waist belt 14 and shoulder supports 16. The waist belt 14 is attached by any suitable apparatus to the carrying portion 12 and is arranged for fastening the carrying portion 12 to the waist of a user.

The shoulder supports 16 are arranged for fastening the carrying portion 12 to the upper body of a user and are, in the present example, integrally formed so as to define, at a first end, a nape portion 18. Shoulder supports 16 also include straps 20 which are attached, as by stitching, to a rear portion of the waist belt 14.

The shoulder supports 16 are attached, via adjustable attachment apparatus, referenced generally 22, to the carrying portion 12. As described in more detail below in conjunction with FIGS. 2A–3B, adjustable attachment apparatus 22 enables adjustment, while the backpack 10 is being worn by the user, of the shoulder supports 16 relative to the carrying portion 12 so as to selectably increase and decrease the distance 'D' between a position 21 of attachment of the shoulder supports 16 to the carrying portion 12 relative to a position 23 of attachment of the waist belt 14 to the carrying portion 12.

In FIG. 1A distance D is illustrated at a maximum, while distance D is illustrated at a minimum in FIG. 1B.

Referring now to FIGS. 2A–3B, adjustment apparatus 22 includes a track 24 (also FIGS. 1A and 1B) mounted onto the carrying portion 12; a sliding buckle 26 attached via a rigid body portion 28, as by stitching 27 (FIG. 2A) to nape portion 18 of shoulder supports 16. Buckle 26 is configured for sliding, via a track engagement portion 25, along the track 24, and has first and second rod-like buckle portions, respectively referenced 30 and 32.

Apparatus 22 further includes a first elongate, flexible fastening strap 34 attached via a first end 33 to the carrying portion 12 and extending through buckle 26 in association with the first buckle portion 30 so as to define a free, second end 35; and a second elongate, flexible fastening strap 36 attached via a first end 37 to the carrying portion 12 and extending through buckle 26 in association with the second buckle portion 32 so as to define a free, second end 39.

As will be appreciated from the ensuing description, the body portion 28 of buckle 26 and the first and second buckle portions 30 and 32 are configured to cooperate so as to selectably lock together the buckle 26 and either of the first and second straps 34 and 36, thereby locking together the shoulder supports 16 to the carrying portion 12 at a selected position along track 24.

Figure 3A:
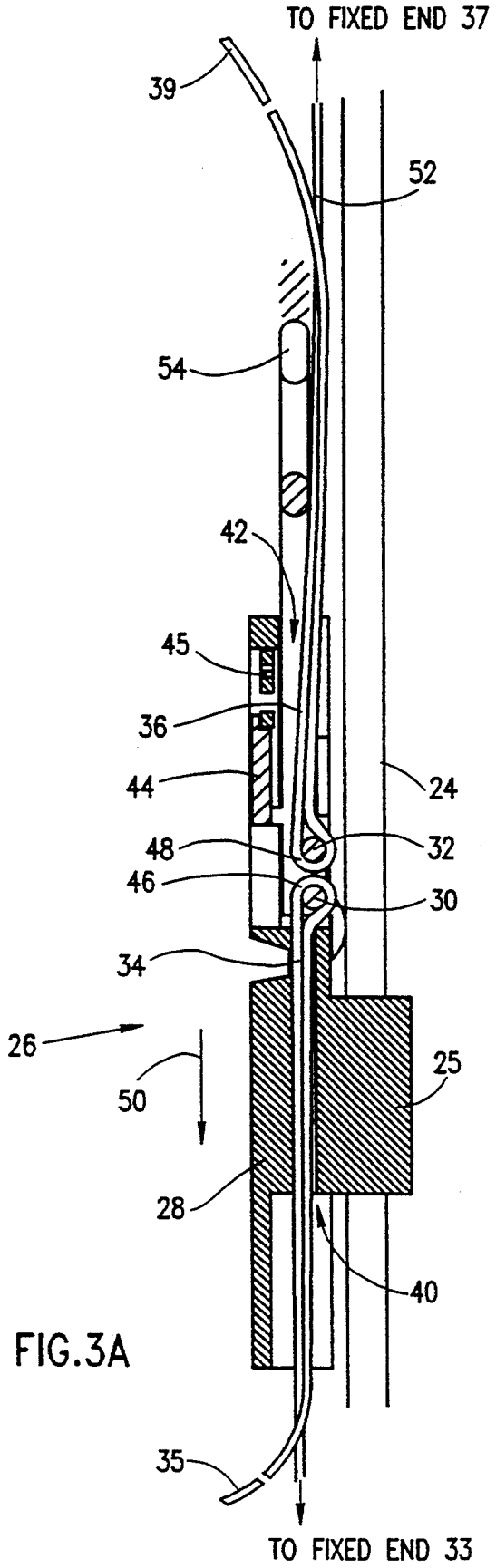
FIG. 3A is an enlarged cross-sectional view of the buckle and straps illustrated in FIGS. 2A–2C, wherein the buckle and lower strap are locked together.
Figure 3B:
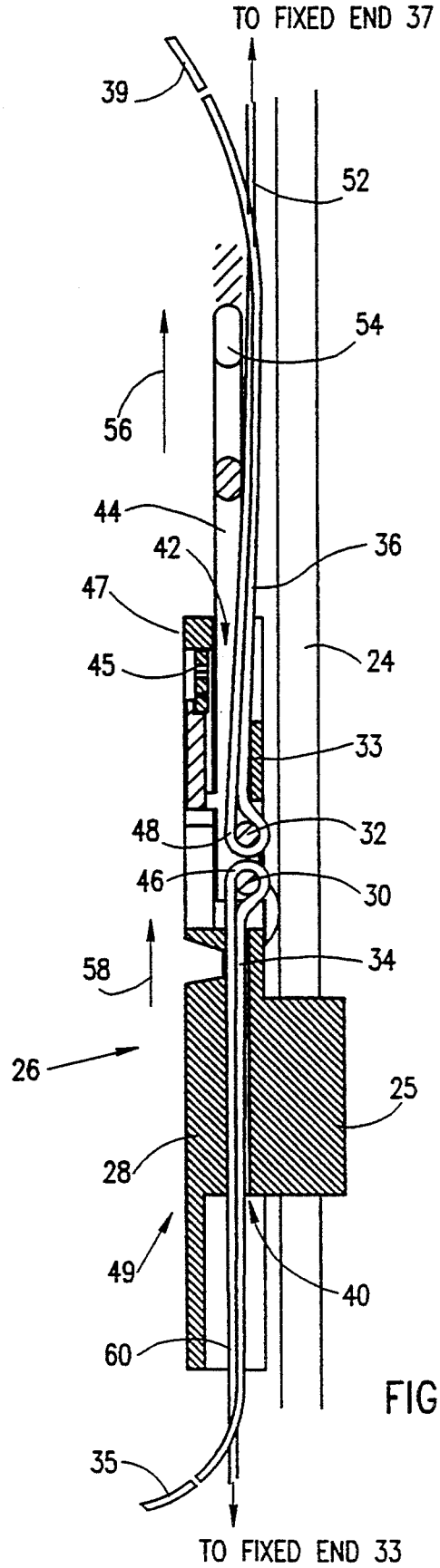
FIG. 3B is a cross-sectional view corresponding to FIG. 3A, but wherein the lower strap has been released from the buckle, thereby permitting an increase in the shoulder support-waist belt distance.

As illustrated in detail in FIGS. 3A and 3B, body portion 28 of buckle 26, which is attached to nape portion 18, and defines first and second openings, respectively referenced 40 and 42 through which the first and second straps 34 and 36 extend respectively. The first and second buckle portions 30 and 32 are mounted onto a generally planar, elongate member 44 which is mounted so as to extend through second opening 42 and such that the buckle portions are positioned within a central space formed in body portion 28. Planar member 44 includes a ring-like handle portion 54, the function of which is described below.

In particular, first buckle portion 30 is arranged across first opening 40 but laterally displaced therefrom, such that, from free end 35 to fixed end 33, the first strap 34 extends along the following path: through first opening 40 tangentially to first buckle portion 30 and circumferentially thereabout so as to form a loop 46, between the first buckle portion 30 and the body portion 28, and back out through the first opening 40.

Similarly, second buckle portion 32 is arranged across second opening 42 but laterally displaced therefrom, such that, from free end 39 to fixed end 37, the second strap 36 extends along the following path: through the second opening 42 tangentially to second buckle portion 32 and circumferentially thereabout so as to form a loop 48 between the second buckle portion 32 and the body portion 28, and back out through second opening 42.

Planar member 44 is mounted within buckle 26 so as to be displaceable relative thereto, thereby causing a similar displacement of buckle portions 30 and 32 and, correspondingly, a displacement of loops 46 and 48. As illustrated, a resilient compression member 45 is provided between planar member 44 and a second end portion 47 of body portion 28, thereby applying a force to planar member 44 in the general direction of a first end 49 of body portion 28.

In the position illustrated in FIG. 3A, wherein buckle 36 is generally vertical, such that a tension force is applied to first strap 34 in the direction indicated by arrow 50, loop 46 of the first strap 34 becomes entrapped between first buckle portion 30 and body portion 28, thereby locking the first strap 34 to the buckle 26, and thereby also locking together the shoulder supports 16 and the carrying portion 12 in the indicated position. In this position, as the clearance between second buckle portion 32 and body portion 28 is sufficiently large, second strap 36 may be pulled, via its free end 39, so as to shorten a portion 52 of second strap 36 between its fixed end 37 and buckle 26, thereby causing a downward movement of fixed end 37 relative to buckle 26 so as to shorten the distance D between the respective locations of attachment of shoulder supports 16 and waist belt 14 to carrying portion 12 (FIGS. 1A and 1B).

Referring now particularly to FIG. 3B, a displacement of planar member 44 via handle 54, away from buckle 26 in the direction indicated by arrow 56, causes a corresponding displacement of the first and second buckle portions 30 and 32, indicated by arrow 58.

The described displacement causes loop 46 of first strap 34 to be freed from its hitherto entrapped position and causes loop 48 of second strap 36 to become entrapped between second buckle portion 32 and an adjacent portion of body portion 28, thereby locking second strap 36 to the buckle 26. In this situation, due to the freeing of first strap 34, the weight of the carrying portion 12 (FIGS. 1A and 1B) or of a load being carried thereby causes first strap 34 to be paid through the buckle 26, thereby lengthening a portion 60 of first strap 34 between its fixed end 33 and buckle 26, thus enabling generally upward movement of buckle 26 along track 24, relative to waist belt 14, so as to lengthen the distance D.

It will thus be appreciated that, as the distance between the respective attachment locations of shoulder supports 16 and waist belt 14 to carrying portion 12 may be adjusted either by pulling strap 39 (shortening) or by pulling handle 54 (lengthening), any adjustments required in the shoulder support-waist belt distance may be effected without having to first remove the backpack 10.

A further feature of the invention is that application of a tension force to portion 52 of second strap 36 will not cause its movement through buckle 26 due to the entrapment of loop 48 between second buckle portion 32 and an adjacent portion 33 of body portion 28. Accordingly, if, when being worn, backpack 10 is tipped such that its load is applied in the direction of an upper portion 62 of carrying portion 12 (FIGS. 1A and 1B), second strap 36 functions as a load-bearing element, and, due to the locking thereof with buckle 26, slipping of the backpack over the shoulders of the user is prevented.

Reference is now made to FIGS. 4–19B, which illustrate another embodiment of the present invention which is characterized in that it provides an automatically adjustable connection between the shoulder straps and the backpack and further characterized in that it provides an easily controllable adjustment of the vertical height of the backpack with respect to the shoulder straps in both vertical directions.

Figure 4:
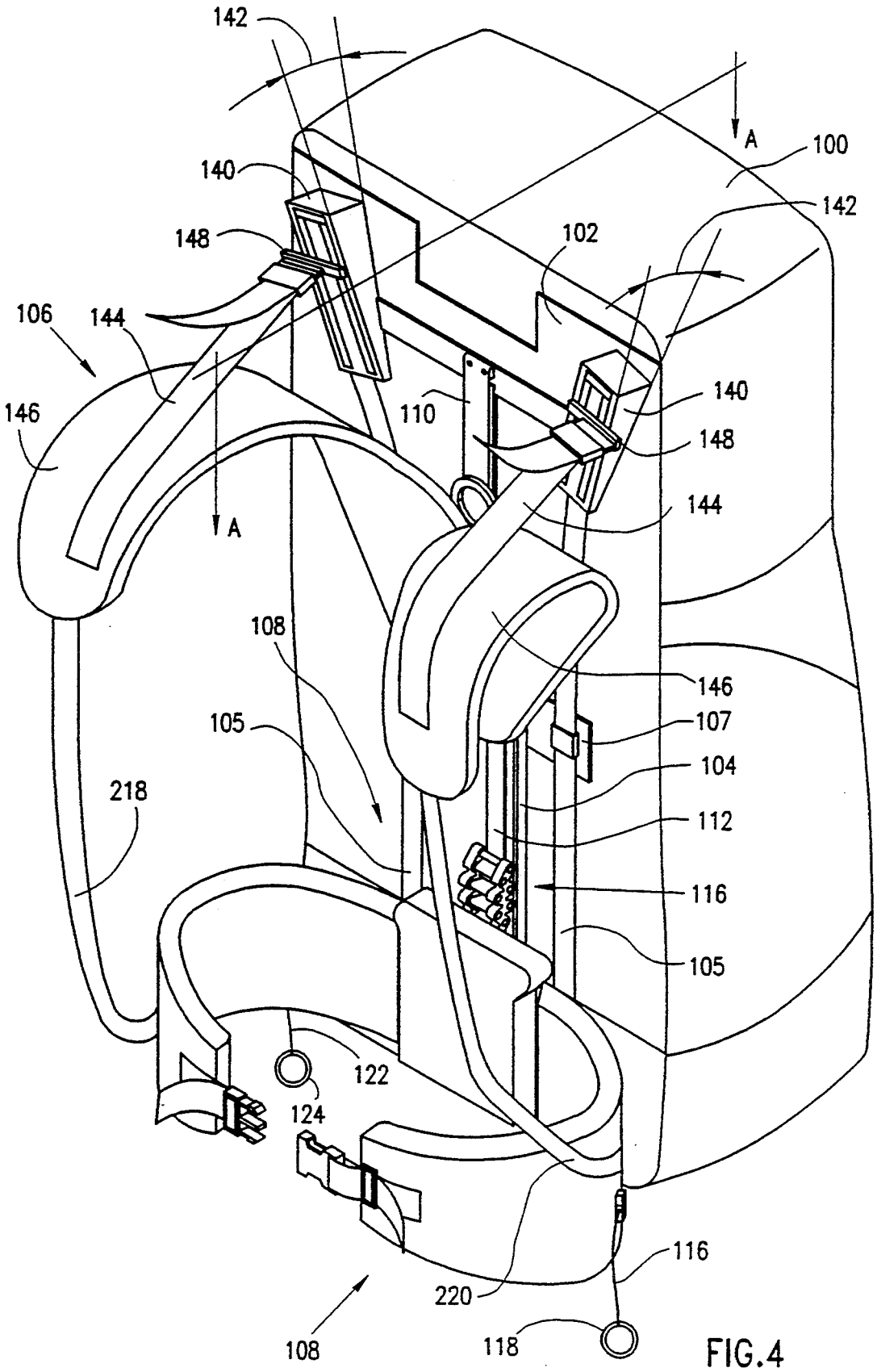
FIG. 4 is a simplified pictorial illustration of a backpack constructed and operative in accordance with another embodiment of the present invention.
Figure 7:
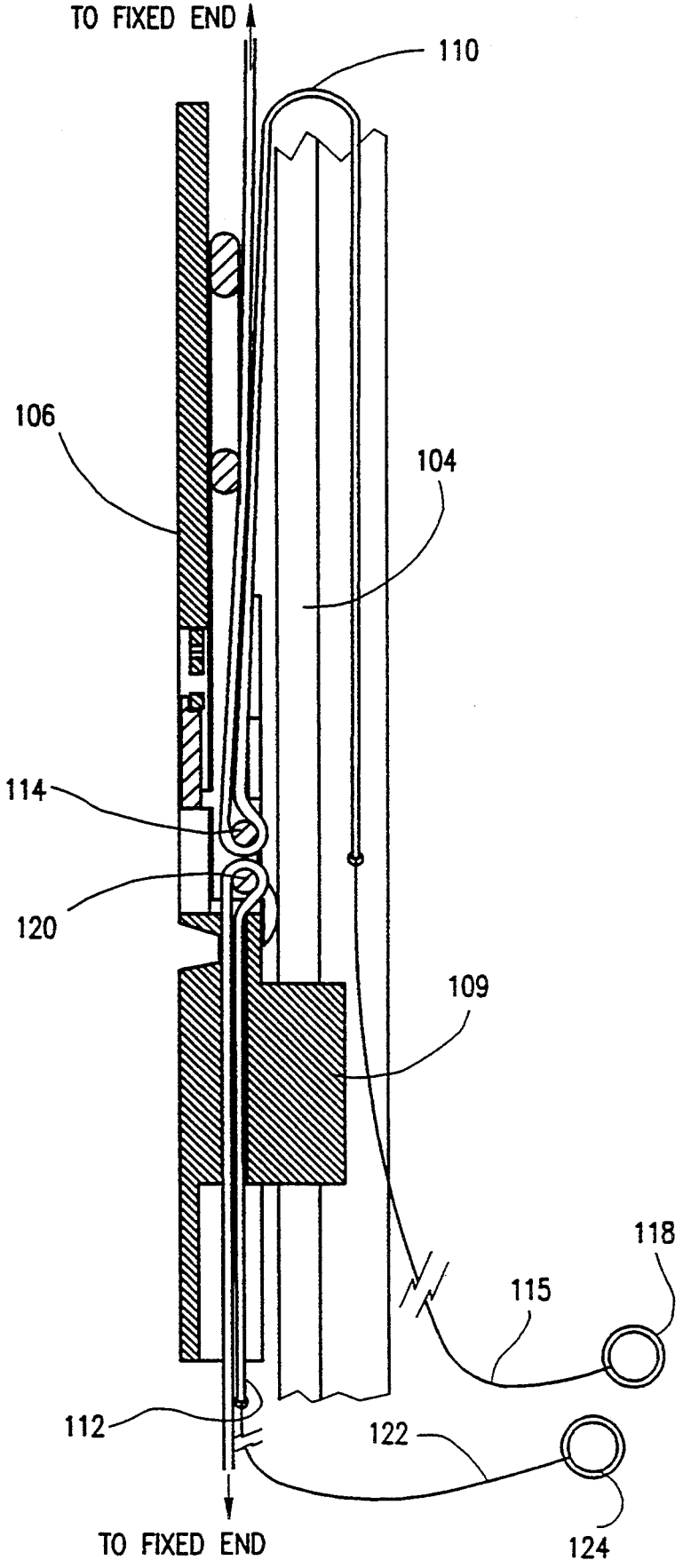
FIG. 7 is a partial sectional illustration of part of the backpack of FIGS. 4–6.
Figure 11:
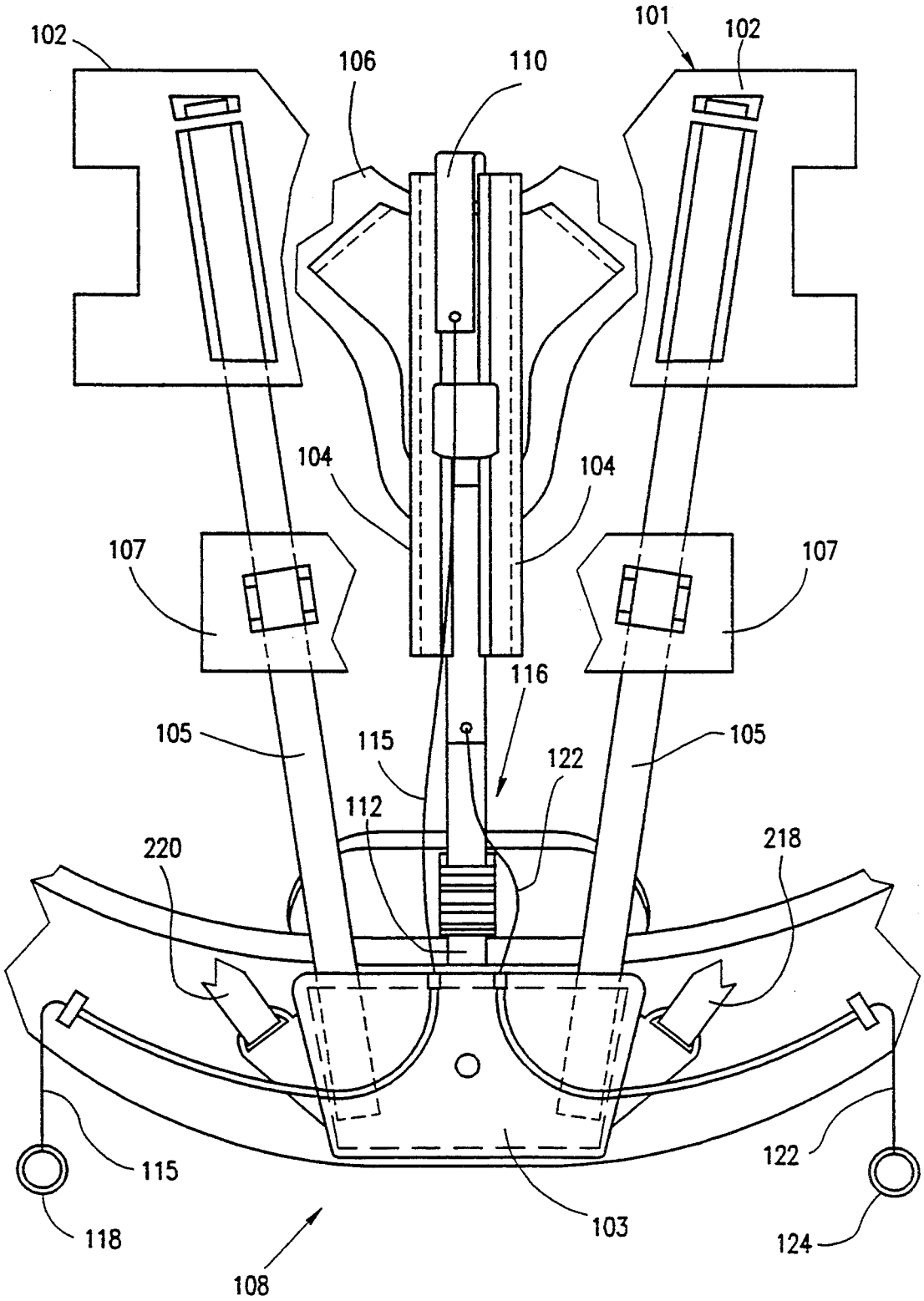
FIG. 11 is a forward facing illustration of the backpack of FIGS. 4–6.
Figure 12:
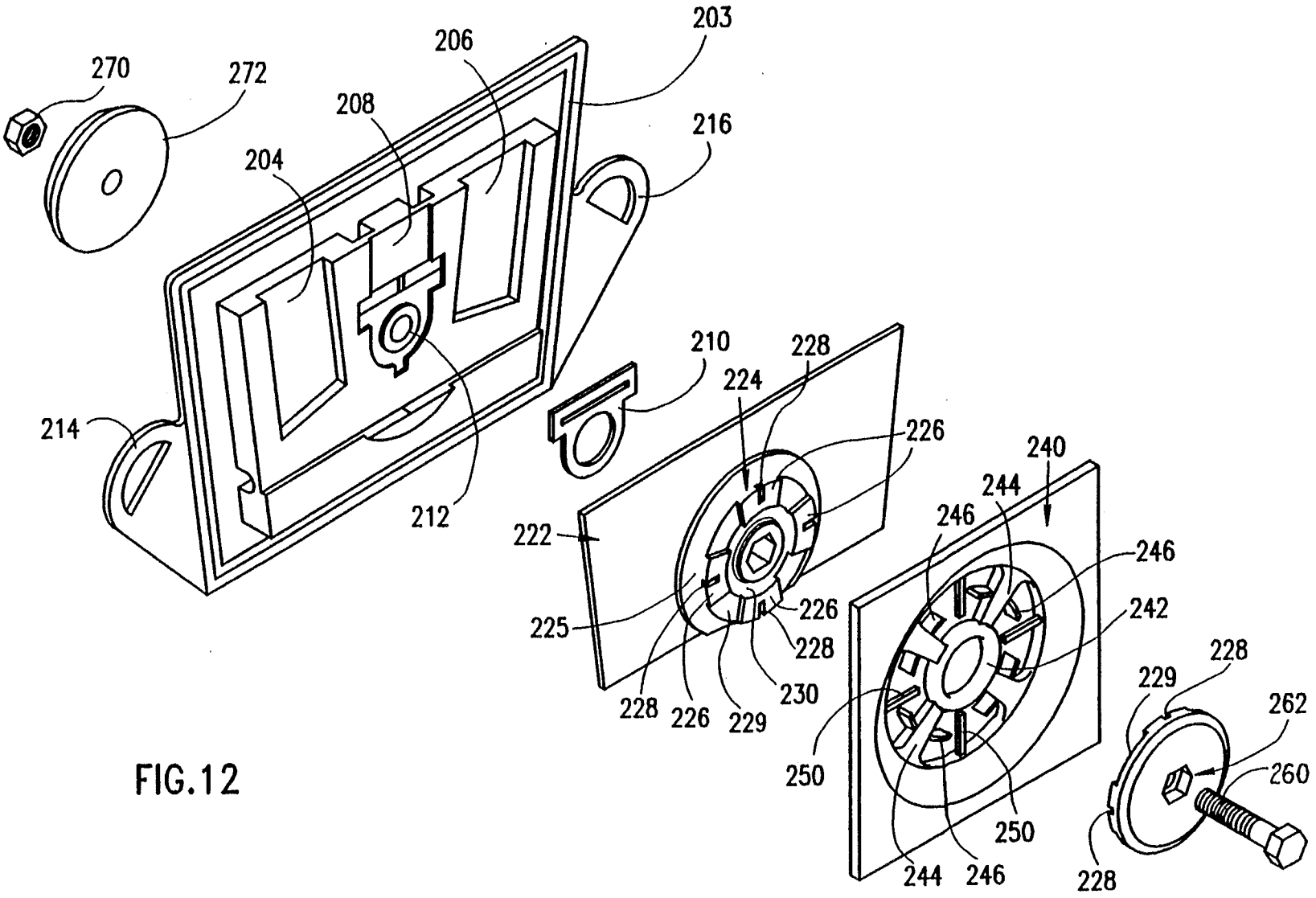
FIG. 12 is an exploded view of a waist band support assembly constructed and operative in accordance with a preferred embodiment of the present invention.
Figure 13:
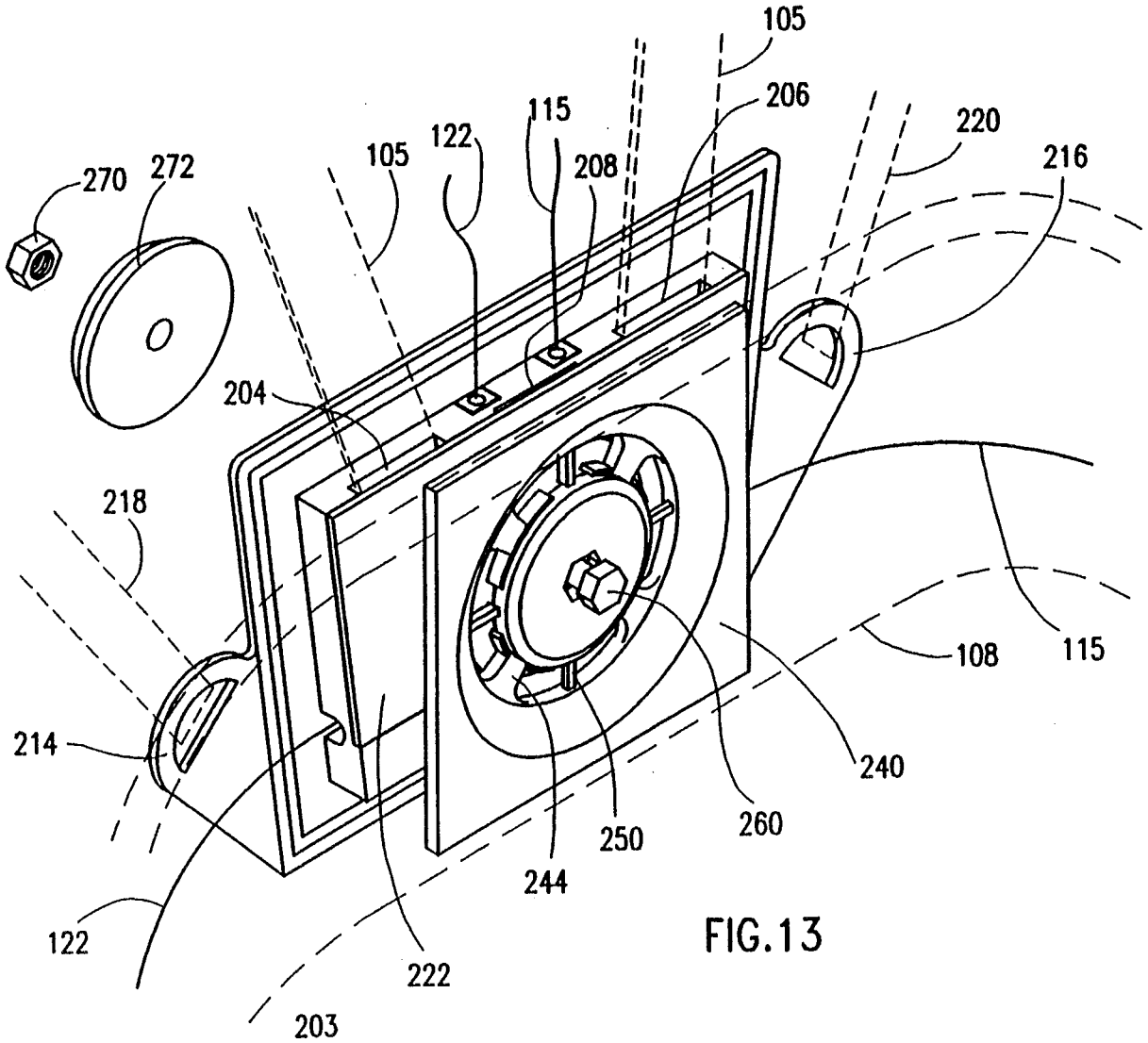
FIG. 13 is a partially assembled illustration of the assembly of FIG. 12.

FIG. 4 illustrates a backpack support assembly in a view directed generally in a first direction, while FIG. 11 illustrates the backpack support assembly generally in an opposite direction, the backpack container portion being cut away. FIG. 7 illustrates a detail of the structure of the backpack of FIGS. 4 and 11.

As seen in FIGS. 4, 7 and 11, the backpack comprises a container portion 100 onto which is fixedly mounted a relatively rigid mounting assembly 101 including a top support portion 102, a bottom support portion 103 and a track portion 104. Portions 101 and 104 may be integrally formed as a single plastic element, while portion 103 is typically separate therefrom.

A pair of generally rigid support strips 105, typically formed of aluminum, join support portions 102, 103 and 104. A shoulder strap support assembly 106 is slidably mounted onto track portion 104 for selectable vertical positioning therealong. A slidable strip riding element 107 which engages strips 105, is preferably integrally formed with track portion 104.

A waist band assembly 108 is pivotably mounted with respect to a fixed location on container portion 100 via bottom support portion 103.

As seen particularly in FIG. 7, the shoulder strap support assembly 106 typically comprises a track rider 109 to which are connected a pair of straps 110 and 112.

Strap 110 includes a fixed end which is fixedly attached to back surface portion 102 adjacent the top of container portion 100 and is slidably looped around a bar 114 mounted on track rider 109, to define a free end which loops around the top of the track portion 104 and then extends downwardly to connect to a cable 115, which terminates in a ring 118.

Strap 112 includes a fixed end which is fixedly attached to the bottom support portion 103 adjacent the bottom of container portion 100 via a resilient strap assembly 116 which may be similar to the resilient strap assembly 116 described and claimed in European Patent Application 92311145.4 of the present applicant/assignee. Strap 112 is slidably looped around a bar 120 mounted on track rider 109, to define a free end which extends downwardly to connect to a cable 122, which terminates in a ring 124.

Fixedly mounted to top support portion 102 at the upper ends of strips 103 are a pair of inclined track members 140, each of which defines a track which is angled downwardly and inwardly, as shown in FIG. 4 and also is tapered at an angle 142 which is preferably selected to be between about 10 and 20 degrees.

Figure 8B:
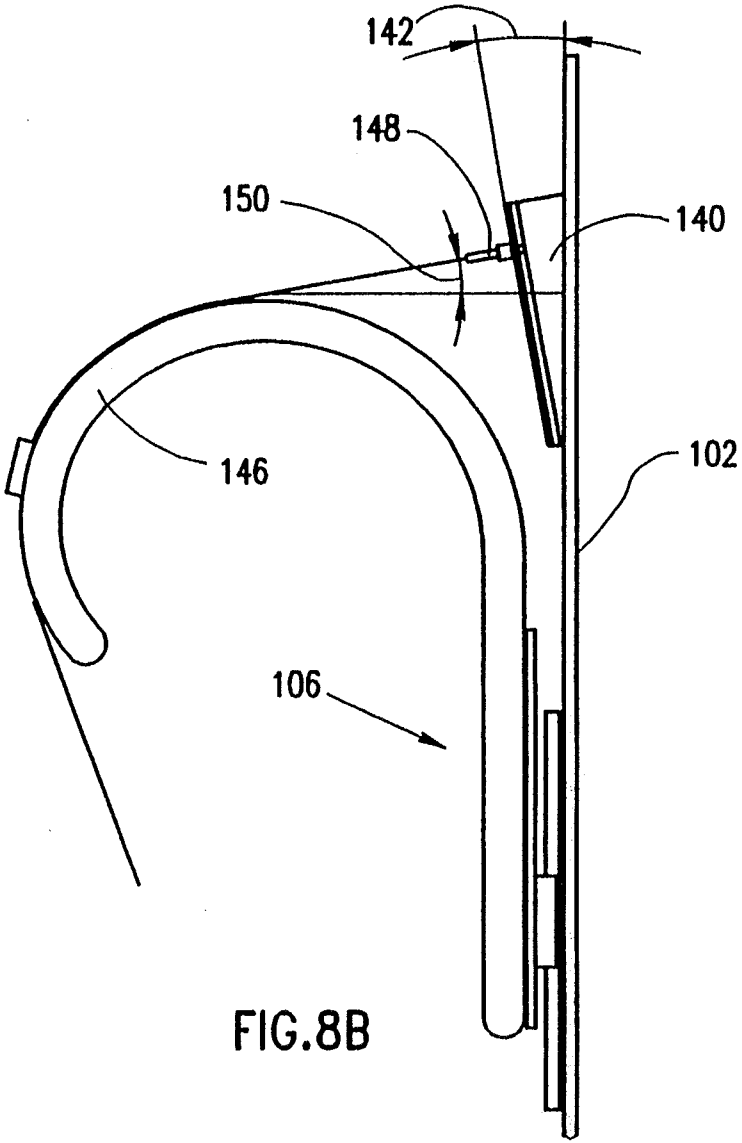
FIGS. 8A and 8B are illustrations of part of the backpack of FIGS. 4–6 in respective second and first operative orientations.
Figure 8A:
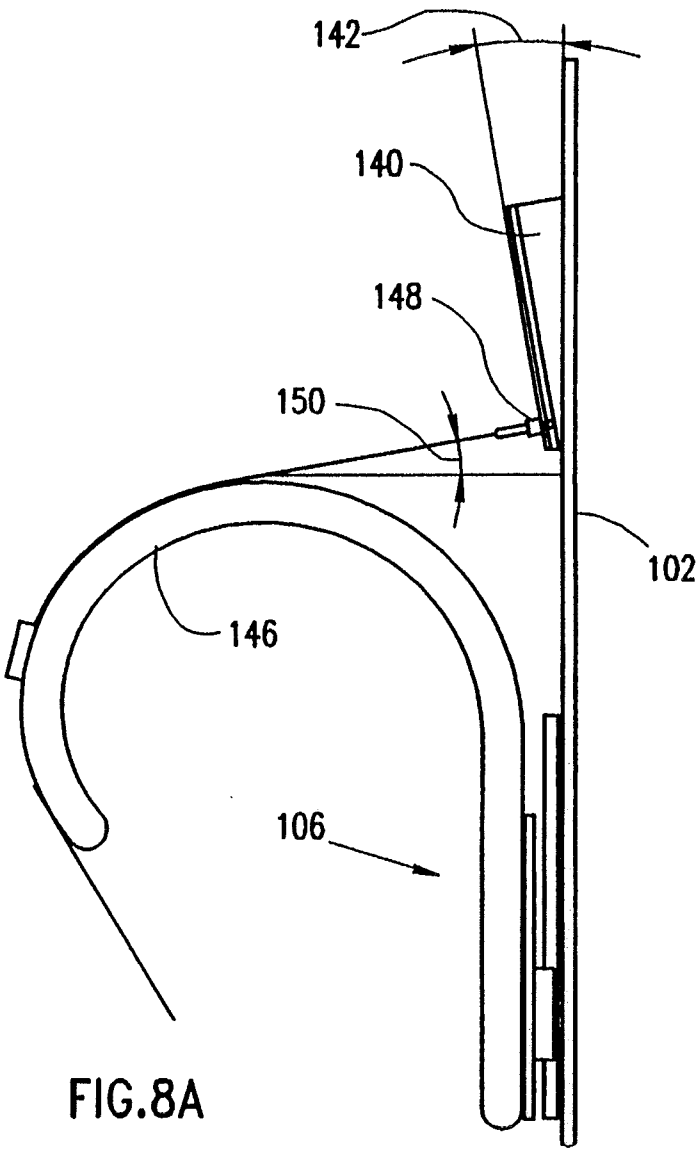

Connection straps 144 are adjustably connected between shoulder pads 146 and track riding buckle members 148, which are slidably retained on track members 140. As seen in FIGS. 8A and 8B, it is a particular feature of the invention that notwithstanding variations in the height of the shoulder pads 146 relative to the container portion 100 of the backpack and thus with respect to track elements 140, an angle 150 of between about 10–20 degrees is maintained between connection straps 144 and the perpendicular to back surface portion 102. This angle is believed to provide maximum comfort of the user.

Figure 9A:
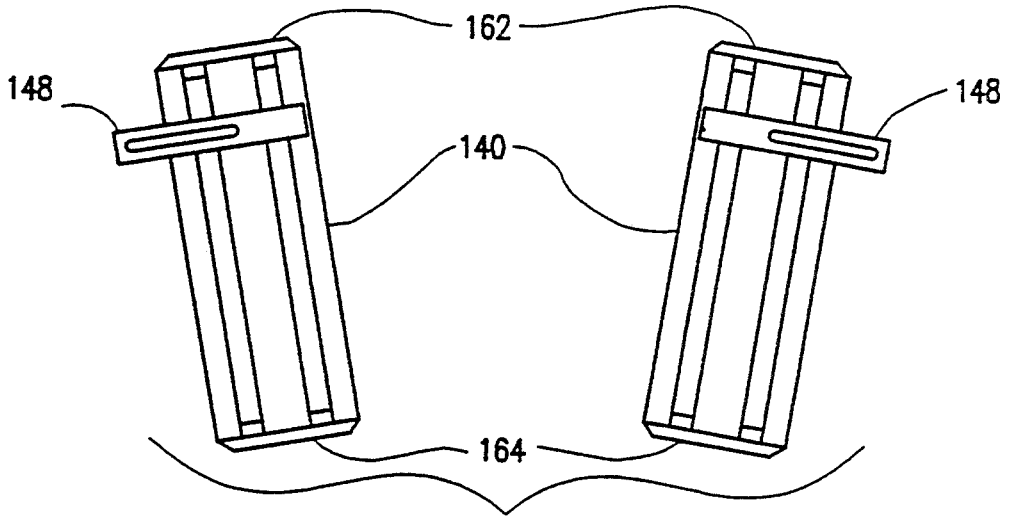
FIGS. 9A and 9B are illustrations of part of the backpack of FIGS. 4–8B in two alternative arrangements.
Figure 9B:
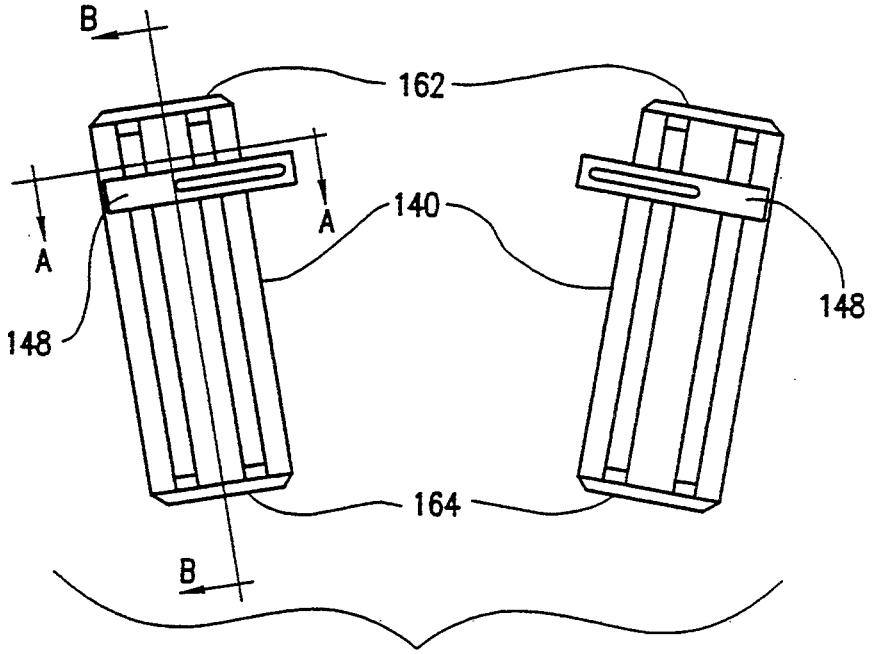

Reference is now made to FIGS. 9A and 9B which illustrate two alternative ways of mounting buckle members 148 on track members 140. In the embodiment of FIG. 9A, the buckle members 148 are arranged in a relatively outward directed orientation, so as to be more suitable for a broad-shouldered wearer, while in the embodiment of FIG. 9B, the buckle members 148 are arranged in a relatively inward directed orientation, so as to be more suitable for a narrow-shouldered wearer. Removable locking member 162 and fixed integrally formed locking member 164 at the ends of the track member 140 enable the orientations of the buckle members to be changed.

Figure 10A:
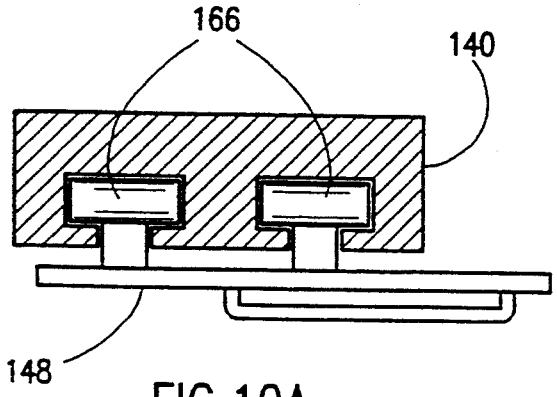
FIGS. 10A and 10B are sectional illustrations taken along lines A—A and B—B respectively in FIG. 9B.
Figure 10B:
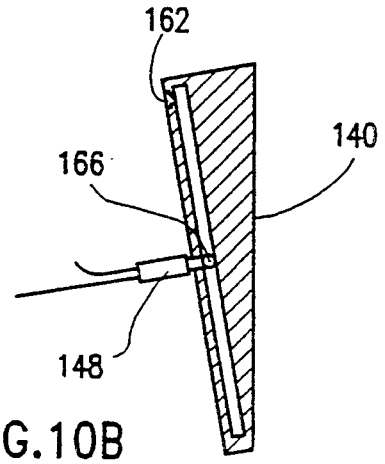

FIGS. 10A and 10B illustrate the construction and interengagement of the track member 140 and the buckle member 148. It is seen that buckle member 148 includes internal riding surface portions 166 which are retained within track slots defined by the track member 140.

Figure 6:
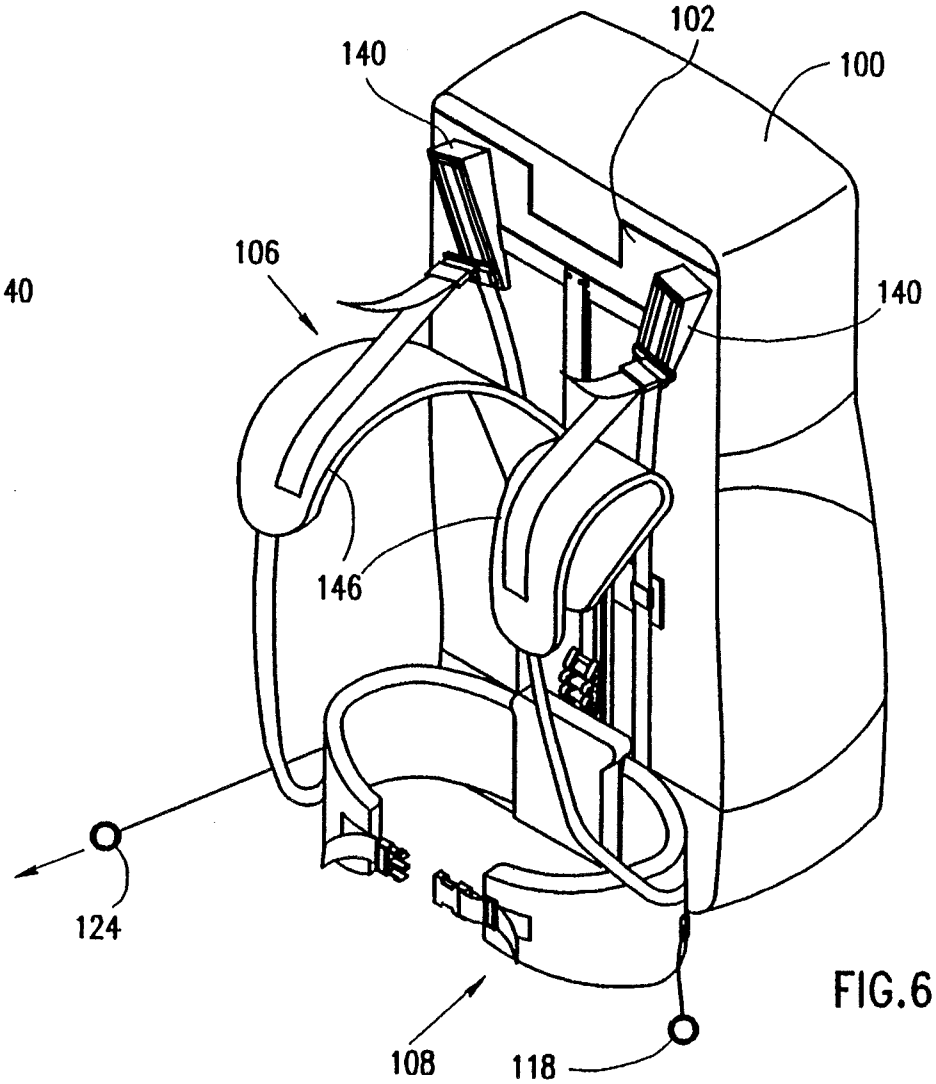
FIGS. 5 and 6 are illustrations of the backpack of FIG. 4 in respective first and second operative orientations.
Figure 5:
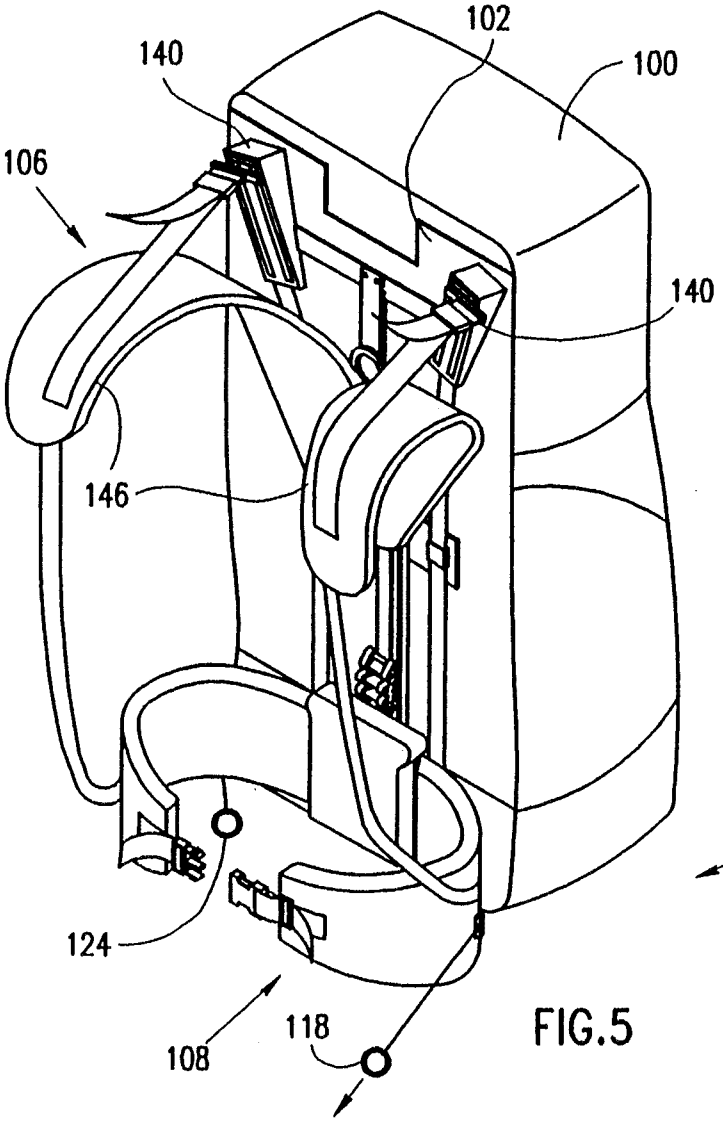

It will be appreciated by persons skilled in the art that the embodiment of FIGS. 4–10B enables the proportion of the weight of the container portion 100 to be allocated between the shoulder strap assembly 106 and the waist band assembly 108 by the wearer's pulling on rings 118 or 124, which are easily accessible at the bottom of the backpack and are mounted on the waist band assembly 108. As seen in FIGS. 5 and 6, raising of the shoulder straps relative to the container portion is achieved by pulling on ring 118, while lowering of the shoulder straps relative to the container portion is achieved by pulling on ring 124.

The provision of inclined, tapered track members 140 and corresponding slidable buckles 148 ensures that within the operating range of container portion positions, the angle of the connecting straps 144 remains generally constant at the desired angle for maximum comfort.

Reference is now made to FIGS. 12–19B, which illustrates apparatus for flexible mounting of the waist band assembly 108 onto the container portion 103 constructed and operative in accordance with a preferred embodiment of the present invention. It is a particular feature of the apparatus of FIGS. 12–19B that multiple degrees of freedom of motion are provided by the apparatus for flexible mounting.

As seen in FIGS. 12–19B, the apparatus for flexible mounting includes a lower support portion 203 which is arranged to be fixedly mounted onto container portion 100 (FIG. 4) and which is provided with first and second recesses 204 and 206 which are configured to receive the bottom ends of strips 105. Lower support portion 203 is also provided with a recess 208 which is arranged to receive the fixed end of strap 112 which is secured by apparatus of a buckle 210 which is retained on a circular protrusion 212 formed on support portion 203. A pair of loops are provided for engagement with shoulder straps 218 and 220 respectively.

Bolted onto lower support portion 203, so as to retain the bottom ends of strips 105 in recesses 204 and 205 is a retaining plate 222 which is formed with a generally circular protrusion 224 disposed inwardly of a tapered outer protrusion 225 and a plurality of azimuthally distributed raised portions 226, each having a central radially extending recess 228. A radially disposed recess 229 is disposed between each raised portion 226. Disposed interior of circular protrusion 224 is a generally annular recess 230.

Bolted to retaining plate 222 is a waist band mounting element 240 onto which a waist band assembly 108 (FIG. 4) is mounted. Waist band mounting element 240 includes a central ring portion 242 which is arranged to seat in recess 230 and a plurality of radially extending ribs 244, each of which is provided with a pair of oppositely directed transversely extending protrusions 246, which are arranged to lie just outside of the periphery of protrusion 224. Ribs 244 each are seated in a recess 229. A plurality of inwardly directed flexible fingers 250 are arranged to engage recesses 228.

Preferably, ribs 244 and fingers 250 are arranged not to lie in a plane but rather are bent in such a way as to position central ring portion 242 in a plane which is closer to retaining plate 222 than is the outer periphery of the waist band mounting element 240.

Cooperating with a bolt 260 is an extended bolt head element 262 having a surface configuration facing retaining plate 222 which is generally identical to the configuration of circular protrusion 224, and thus includes a plurality of azimuthally distributed raised portions 226, each having a central radially extending recess 228, a radially disposed recess 229, disposed between each raised portion 226 and, disposed interior of circular protrusion 224, a generally annular recess 230.

Suitable tightening of extended bolt head element 262 thus retains central ring portion 242 in opposite facing recesses 230, radially extending ribs 244 in opposite facing recesses 229 and flexible fingers 250 in opposite facing recesses 228.

Bolt 260 is engaged in suitably threaded socket 270, which; cooperates with an enlarged socket knob 272.

The various degrees of freedom of movement of waist band mounting plate 240 relative to retaining plate 222 and bottom support portion 203 are illustrated in FIGS. 14–19B.

Figure 14:
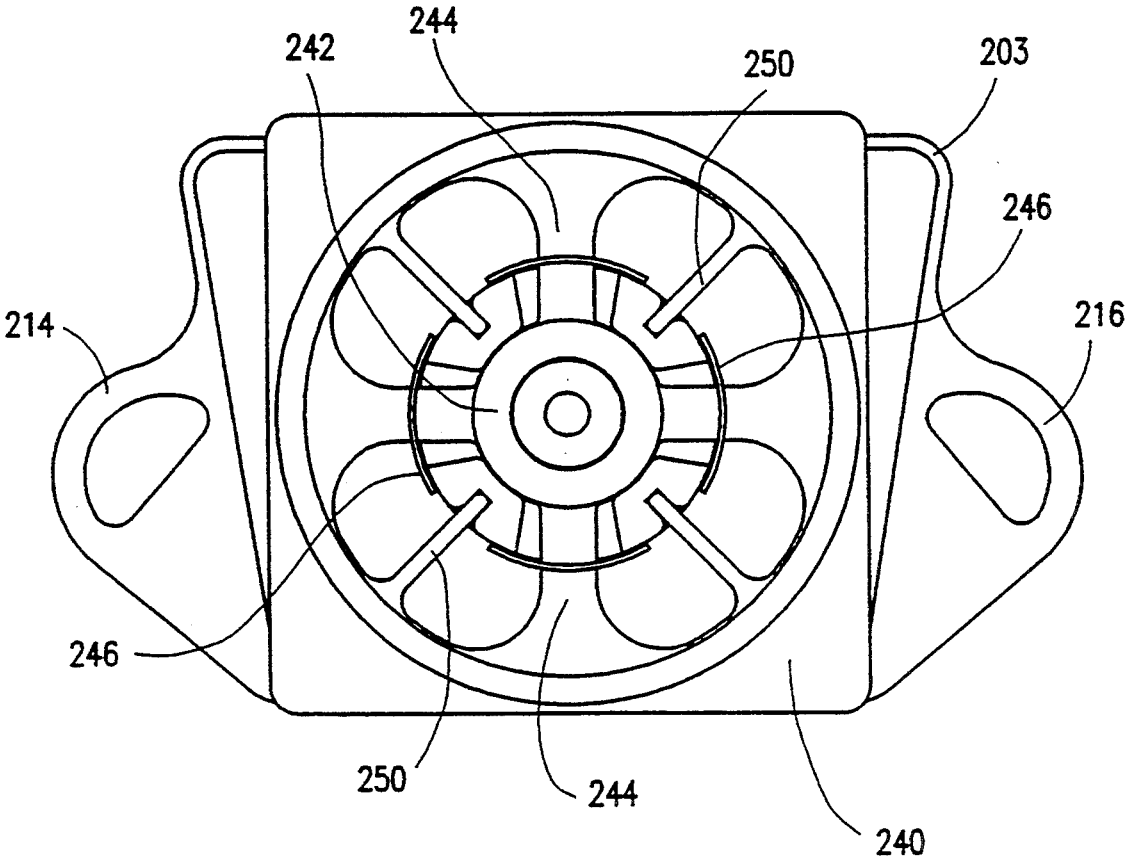
FIGS. 14, 15A and 15B are illustrations of the assembly of FIGS. 12 and 13 in respective first, second and third operative orientations.
Figure 15A:
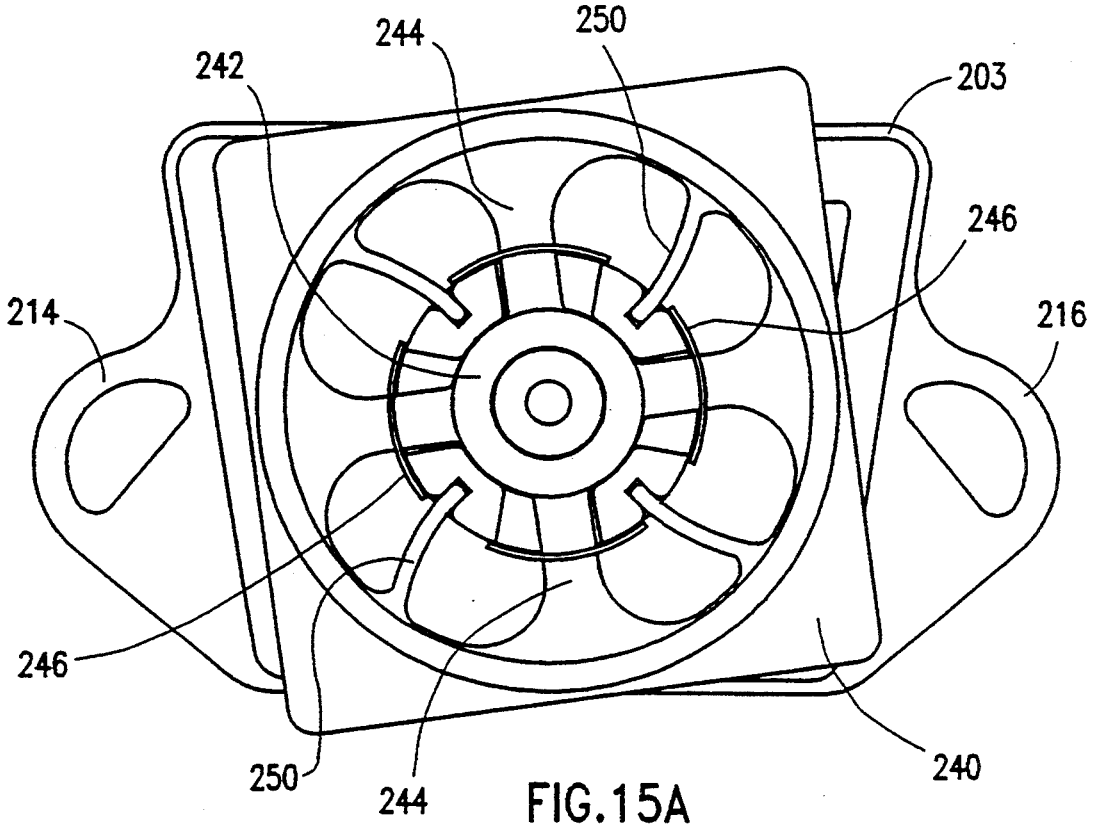
Figure 15B:
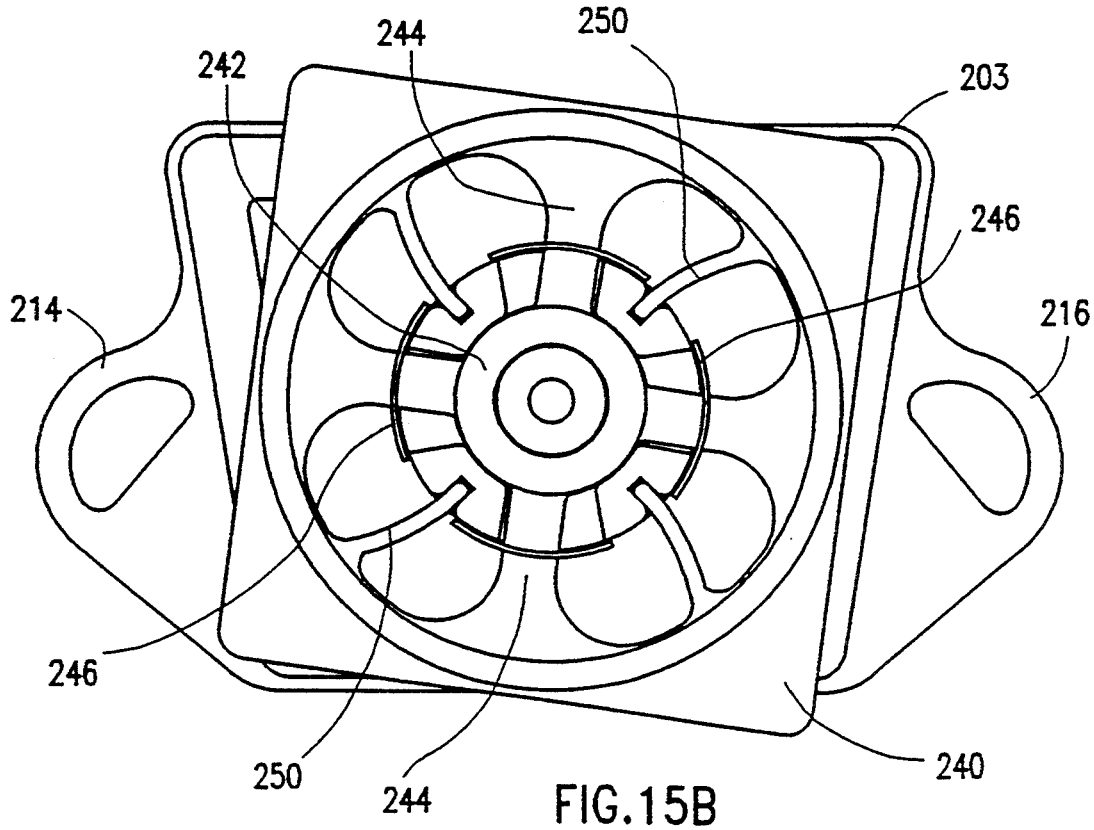
Figure 16:
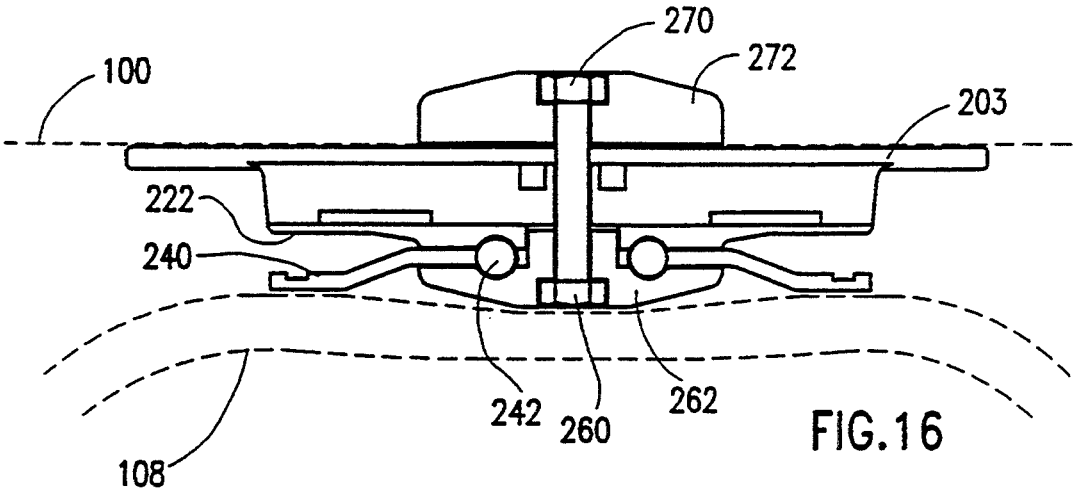
FIGS. 16, 17A and 17B are illustrations of the assembly of FIGS. 12 and 13 in three different positions.
Figure 17A:
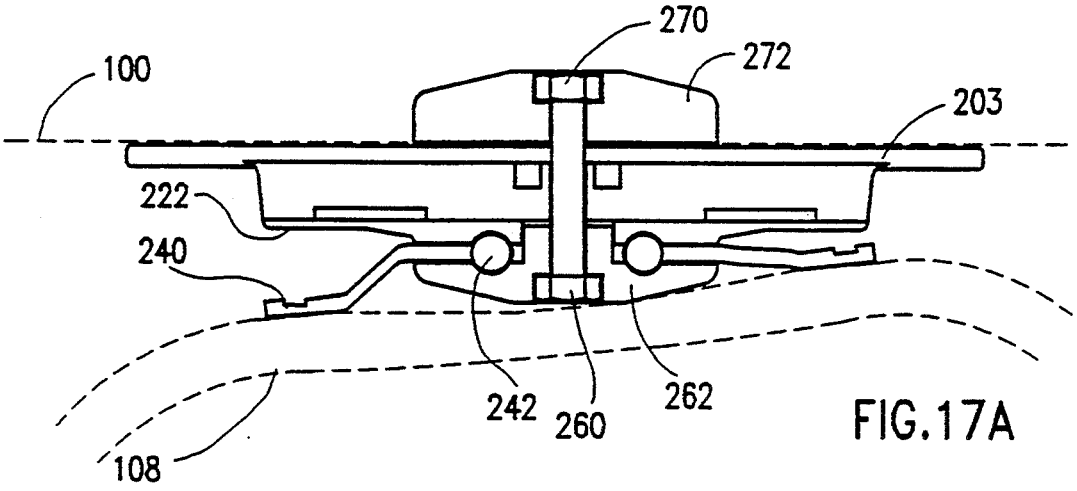
Figure 17B:
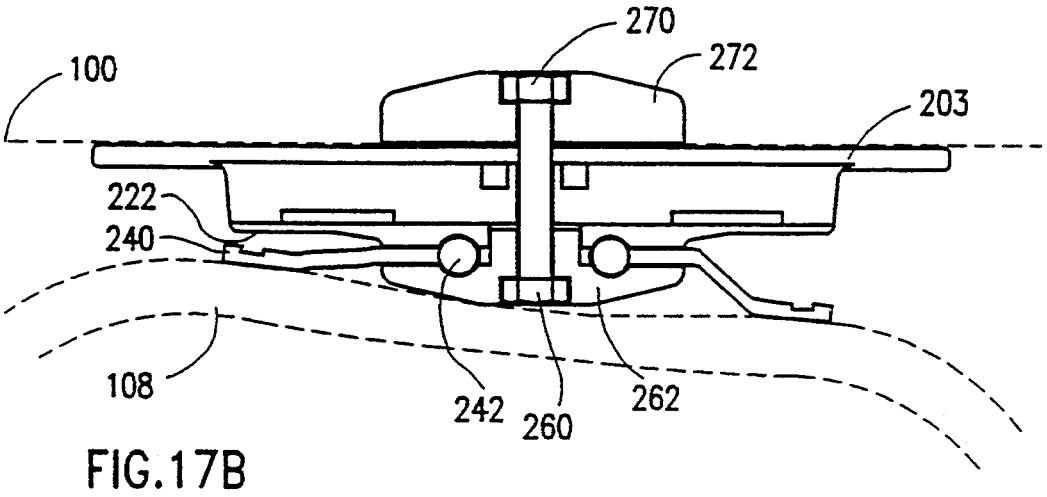
Figure 19B:
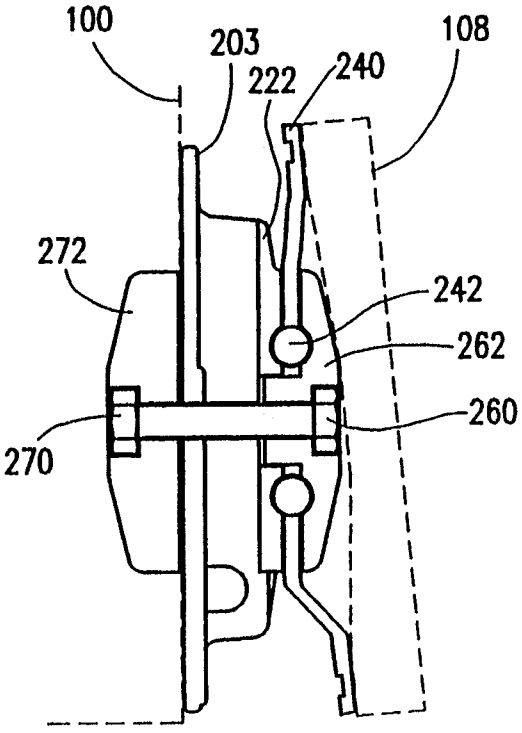
FIGS. 18, 19A and 19B are illustrations of the assembly of FIGS. 12 and 13 in another three different positions in a plane perpendicular to the plane of FIGS. 16, 17A and 17B.
Figure 19A:
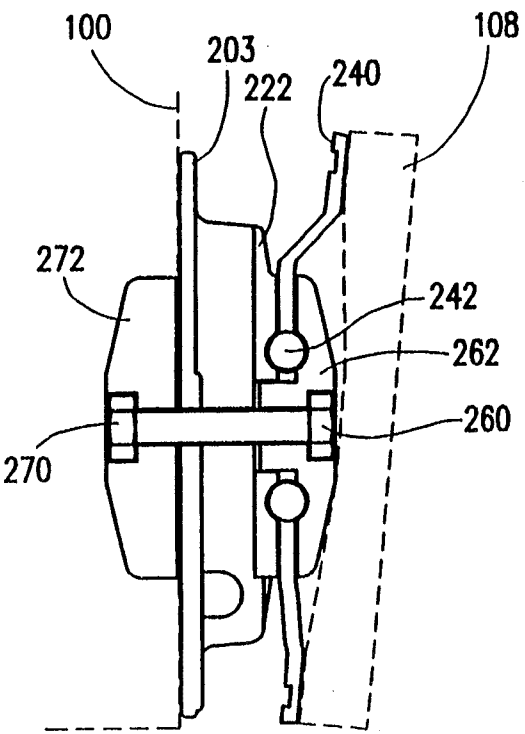
Figure 18:
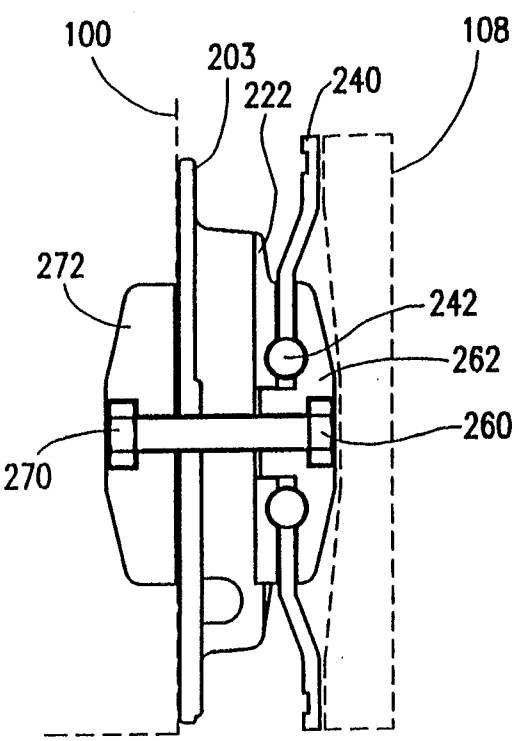

FIG. 14 illustrates a nominal relative orientation of plate 240 relative to portion 203, while FIGS. 15A and 15B illustrate relative rotation therebetween in two opposite directions. FIG. 16 illustrates a nominal relative orientation of the waist band assembly 108 relative to container portion 100, while FIGS. 17A and 17B show orientations where different sides of the waist band 108 are respectively closer to or further from the container portion 100. FIG. 18 illustrates a nominal relative orientation of the waist band assembly 108 relative to container portion 100, while FIGS. 17A and 17B show orientations where either the top or the bottom of the waist band assembly is tilted away from the container portion 100.

It will be appreciated that the present invention is not limited to application to a backpack or to any particular type of backpack, but rather is applicable to any suitable type of load support which is carried on a user's back, i.e. his shoulders and/or hips.

For simplicity and clarity, various features have been separately described herein in the context of separate embodiments. However, these features may, of course, be provided in any suitable combination within a single pack.

It will be appreciated by persons skilled in the art that the present invention is not limited by what has been described hereinabove by way of example. The scope of the invention is limited, rather, solely by the claims which follow.

I claim:

1. A backpack comprising:

an article carrier;

a waist belt attached to said article carrier at a first position of attachment and arranged for fastening said article carrier about the waist of a user;

a shoulder support arranged for fastening said article carrier about an upper body portion of the user; and an attachment assembly for attaching said shoulder support to said article carrier at a second position of attachment and including an adjustment subassembly for adjusting the position of attachment of said shoulder support to said article carrier so as to selectably increase and decrease the distance between said second position of attachment of said shoulder support to said article carrier relative to the first position of attachment of said waist belt to said article carrier while said backpack is being worn by the user, and wherein said adjustment subassembly comprises first and second manual engagement elements movably mounted onto said waist belt and being accessible to the user adjacent the waist belt, whereby pulling on said first manual engagement element raises the second position of attachment of said shoulder support relative to the first position of attachment of said waist belt and pulling on said second manual engagement element lowers the second position of attachment of said shoulder support relative to the first position of attachment of said waist belt.

2. A backpack according to claim 1 and wherein said adjustment subassembly comprises;

a track mounted onto said article carrier;

a sliding buckle attached to said shoulder support and configured for sliding along said track and having a body portion and first and second buckle portions;

a first elongate, flexible fastening element attached to said article carrier and extending through said buckle in association with said first buckle portion; and a second elongate, flexible fastening element attached to said article carrier and extending through said buckle in association with said second buckle portion:

and wherein said body portion and said first and second buckle portions are configured to cooperate so as to selectably lock together said buckle and at least one of said first and second flexible fastening elements, thereby locking together said shoulder support and said article carrier and preventing said buckle from sliding in said track, and said first manual engagement element being connected to said first flexible fastening element and said second manual engagement element being connected to said second flexible fastening element.

3. A backpack according to claim 1 and also comprising a waist belt mounting assembly for attaching said waist belt to said article carrier and providing multiple degrees of freedom of motion between said waist belt and said article carrier.

4. A backpack according to claim 3 and wherein said multiple degrees of motion include at least rotation in a substantially vertical plane and pivoting motion in at least one plane perpendicular to said substantially vertical plane.

5. A backpack an article carrier;

a waist belt attached to said article carrier and arranged for fastening said article carrier about the waist of a user;

a shoulder support arranged for fastening said article carrier about an upper body portion of the user; and a connection strap assembly including a pair of inclined track elements in connection with a back surface of the article carrier, a pair of track riding buckle members which are slidably retained on said track elements, respectively, and a pair of connection straps joined by the track riding buckle members between the track elements and the shoulder support, wherein said connection strap assembly is configured such that notwithstanding variations in the height of the shoulder support relative to the article carrier, an angle of between about 10–20 degrees is maintained between the connection straps and a perpendicular axis to the back surface of the article carrier, and wherein said track riding buckle members are reversibly mountable onto said track elements thereby to adapt to different user body girths.

6. A backpack according to claim 5 and wherein said track elements are inclined inwardly and downwardly relative to said back surface.

* * * * *